United States Patent [19]
Svoboda et al.
[11] 4,294,462
[45] Oct. 13, 1981

[54] SPRING LOCKING DEVICE

[75] Inventors: Josef Svoboda, Schwechat; Herbert Wuerthner, Hainburg; Karl Stritzl, Vienna, all of Austria

[73] Assignee: TMC Corporation, Baar, Switzerland

[21] Appl. No.: 106,054

[22] Filed: Dec. 21, 1979

Related U.S. Application Data

[62] Division of Ser. No. 900,302, Apr. 26, 1978, Pat. No. 4,213,630.

[30] Foreign Application Priority Data

Apr. 27, 1977 [AT] Austria ..... 2929/77

[51] Int. Cl.[3] ..... A63C 9/08
[52] U.S. Cl. ..... 280/634; 292/307 R
[58] Field of Search ..... 280/634, 611, 626, 628–632; 292/307 R; 70/455

[56] References Cited

FOREIGN PATENT DOCUMENTS 296838 2/1972 Austria .
308602 7/1973 Austria .
1808466 6/1970 Fed. Rep. of Germany .
2634441 2/1977 Fed. Rep. of Germany .
1324973 7/1973 United Kingdom .

*Primary Examiner*—Robert R. Song
*Attorney, Agent, or Firm*—Blanchard, Flynn, Thiel, Boutell & Tanis

[57] ABSTRACT

A spring locking device for preventing unauthorized adjustment of the spring force subsequent to an adjustment conducted by a person having skill in the art. The spring locking device is composed of a seal which is positioned in a blocking relation with respect to the adjusting member and will be either totally destroyed if an effort is made to adjust the force of the spring or at least reflect that the adjustment has been tampered with. The seal can be in the form of a member which is press fit into an opening adjacent the adjusting member or it can be cast or poured in a liquid form and subsequently solidified in the opening adjacent the adjusting member. In addition, the seal can have an identification indicia placed thereon to reflect the last skilled person to make the adjustment to the spring force.

4 Claims, 8 Drawing Figures

SPRING LOCKING DEVICE

This is a division of application Ser. No. 900,302, filed Apr. 26, 1978, now U.S. Pat. No. 4,213,630.

FIELD OF THE INVENTION

The invention relates to a spring locking device, in particular for a release ski binding, which for changing the effective locking power of the spring which acts onto the locking member has an adjustable spring abutment, which is closed off by a seal for preventing an unauthorized adjustment or for indicating an attempt to make such an adjustment.

BACKGROUND OF THE INVENTION

Generally all modern ski bindings have, for changing the release force, at least one adjusting device. If only one adjusting device is provided, then the danger exists that the skier makes himself changes to the adjusting device which has been initially adjusted by the man skilled in the art, which causes the release values to be not or not always in correspondence with the release values needed for the skier. To overcome these difficulties, devices are also known, which have two adjustment possibilities, namely a basic adjustment, a so-called rough adjustment and a fine adjustment. The basic adjustment is thereby made by the man skilled in the art and can only be changed by him; the change in the fine adjustment can also be made by the skier himself. The fine adjustment is limited to a certain hardness range—within each step of the basic adjustment, so that the skier cannot make any important changes in the adjusting force. The measure requires, however, additional materials and expenditures. Such a device is described in Austrian Pat. No. 296838.

Austrian Pat. No. 308602 describes a similar device wherein the adjusting device has a projection which extends in longitudinal direction of the final control element and into the path of the cylindrical wall of the projection extends the end of a small screw which extends transversely to the longitudinal direction of movement of the final control element. Operation of the screw is limited to the usage of a corresponding special tool, which is available only in special stores. Since the fine adjustment can be done by the skier by using simple means, for example a coin, it is not assumed that he will carry along during skiing an additional and special tool.

In spite of this, this solution is not quite satisfactory, because an unauthorized adjustment for which the special shop can no longer take the responsibility, can later on not clearly be determined. In the case of disputes which occur due to an injury and which are due to an incorrect adjustment of ski bindings and in the case of which the liability of the special store is important, it is therefore necessary to provide a device which does away with the use of two adjusting devices and facilitates a later determination of an unauthorized handling.

Such a solution is known from German OS No. 18 08 466. In this device, the adjusting device is stored in a sealed housing or the screw which effects the adjustment is directly sealed. The seal is thereby mounted in a conventional manner so that the man skilled in the art must obtain and use an additional sealing tool.

The purpose of the invention is to overcome the disadvantages of all mentioned solutions and to provide a simple and secure method for closing off the adjusting device. The above-mentioned fine adjustment by the skier is also possible without requiring special structural parts.

In this manner, not only is the set purpose satisfactorily attained, but the skier has also the possibility to make, in the case of a need, the adjustment himself. During the subsequent skiing with such an adjusted binding, the otherwise responsible man skilled in the art is free from his liability. After such a skiing, the skier must hand over the adjusting device, which he himself opened and adjusted, for the correct adjustment and for the purpose of installing a final seal again by the man skilled in the art. The dealer is liable for a correct adjustment of the ski binding only when same has a seal which is still intact.

To assure that the special dealer is liable exclusively for the correct adjustment of the ski bindings which had been adjusted by him, according to a further characteristic the invention includes the provision of closing elements which are to be inserted with a certain marking thereon identifying the dealer. This is handled in the simplest manner by the manufacturer supplying the special stores with suitably marked closing elements.

As already mentioned above, it is also assured that the skier can perform the fine adjustment within a certain limit without destroying or damaging the closing element (the seal). This is achieved according to a further characteristic of the invention by the final control element being freely supported for a limited rotation at least by one stop within the certain limit, which is preferably smaller than 360°.

BRIEF DESCRIPTION OF THE DRAWINGS

Further advantages and details of the invention will be described more in detail with reference to the drawings, which illustrate several exemplary embodiments.

In the drawings:

FIGS. 1 and 2 illustrate a first exemplary embodiment of the spring locking device on a front jaw, which spring locking device is provided with an inventive seal, wherein FIG. 1 is a partially sectioned side elevational view and FIG. 2 is a front view;

FIGS. 5 and 6 illustrate a further exemplary embodiment of the seal on a different heel holder, wherein FIG. 5 is a longitudinal cross-sectional view of the rear portion of the heel holder and FIG. 6 is a rear view thereof; and FIGS. 7 and 8 illustrate still a further exemplary embodiment with a finely adjustable final control element, wherein FIG. 7 is a longitudinal central cross-sectional view and FIG. 8 is a rear view of FIG. 7.

DETAILED DESCRIPTION

Figure 1:
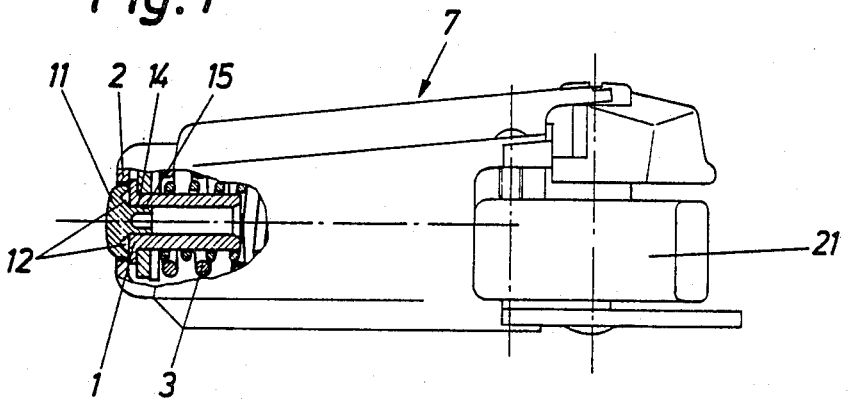
Figure 2:
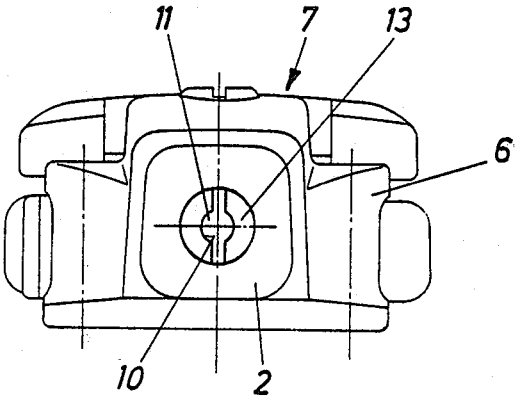

Only the parts of a ski binding 7 which are important with reference to the invention or which are needed for a better understanding of the invention will be described in the following examples. The ski binding 7 is shown in a front view in its totality in FIG. 1 and the portion of the ski binding which forms the subject matter of the invention is in section. A final control element 1 which operates a spring 3 can thereby be recognized, which is supported at its end which is remote from the spring 3 on a mounting member 2. The mounting member 2 is slidably movably supported in a housing 6 (compare FIG. 2) thereby defining a slide member which is not shown in detail here, on which slide member at the end remote from the final control element 1 there are supported the short arms of the bell-cranklike sole holders 21 which engage the ski boot. Thus, any movement of the sole holders is transmitted to the mounting member to cause it to move along the length of the ski. The final control element 1 has an outwardly projecting head 13 having a slot therein. A closing element 11 is inserted into said slot and has preset breaking points 12 thereon. The closing element 11 also has extensions 15 thereon which project into a central hole in the final control element 1. The extension 15 is pressed with a forced fit or press fit into the central hole and slot, so that this structural part can no longer be removed from the slot without visible damage after being pressed in. For the removal, the closing element 11 is broken at one of the preset breaking points. If an attempt should be made to remove the closing element 11 from the press fit connection to the final control element 1 without breaking same, this attempt will necessarily cause damage visibly recognizable to the surface of the closing element. The man skilled in the art is, therefore, freed from his liability as soon as the closing element is broken open or shows damage thereto caused by an attempt to break it open.

Figure 5:
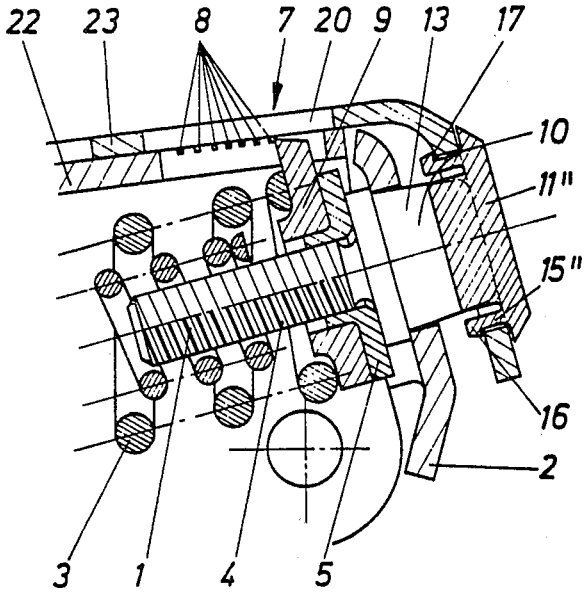
Figure 6:
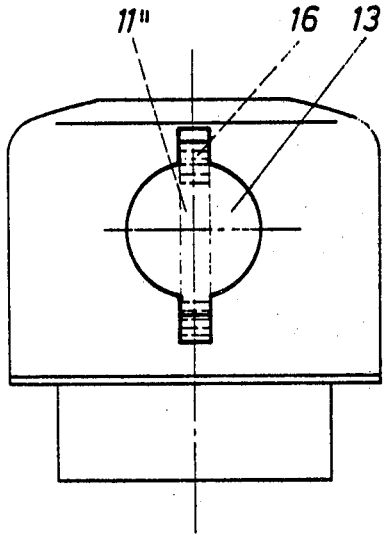

The details of the subject matter of the invention are illustrated better in FIG. 5 in an enlarged scale, wherein in the embodiment according to FIGS. 5 and 6, the closing element 11'' is constructed in a modified manner.

The final control element 1 is supported longitudinally movably in the mounting member 2, which is constructed as part of a spring yoke 22, against the force of a spring 3 in the housing 6. The final control element 1 has a thread 4 thereon threadedly engaged with a nut 5. An indicator 9 is operatively connected to the final control element 1, which indicator is in alignment with markings 8, which are visible through a window 20 in a cover 23 (or in the housing 6) of the ski binding, depending on the position of the final control element 1. To operate the final control element 1 for the purpose of adjusting the initial tension of the spring 3, the final control element has a slot 10 therein. The closing element 11'' is inserted into said slot 10. The construction of this closing element will be discussed hereinbelow. This will prevent, as already mentioned, an unjustified adjustment of the final control element 1, or such adjustment will be detectable later on.

Figure 3:
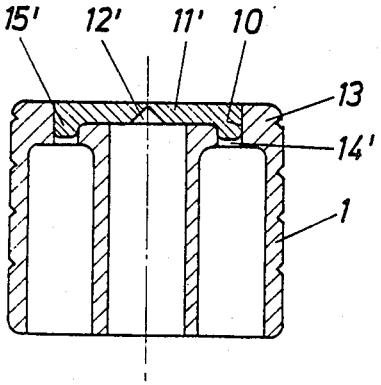
FIGS. 3 and 4 are a cross-sectional and end view of a second exemplary embodiment of the seal.
Figure 4:
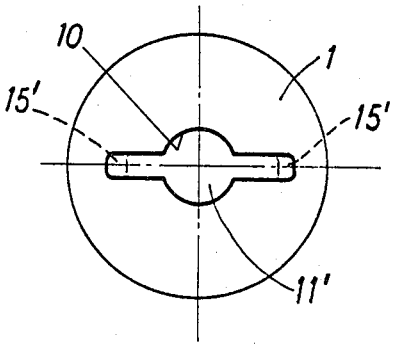

In the exemplary embodiment according to FIGS. 3 and 4, the head 13 of the final control element 1, which head has the slot 10 therein, has two laterally offset receiving openings 14' in the slot which receive the extensions 15' of the closing element 11' therein. The closing element 11' is of a brittle material, so that after being pressed into the slot 10 the closing element 11' can no longer be removed therefrom without damage thereto at, for example, the preset breaking point 12'. The cross section of the extensions 15' may be as desired, for example circular, triangular, square or multiangular.

In the already mentioned exemplary embodiment according to FIGS. 5 and 6, the closing element 11'' has hooks or barbs 16 on the extensions 15'', which after insertion of the closing element 11'' into the slot 10 engage abutments 17 on the cover 23 (or on the housing 6). After engagement has occurred, the closing element 11'' can no longer be removed from the slot 10 without destroying the structure thereof.

Figure 7:
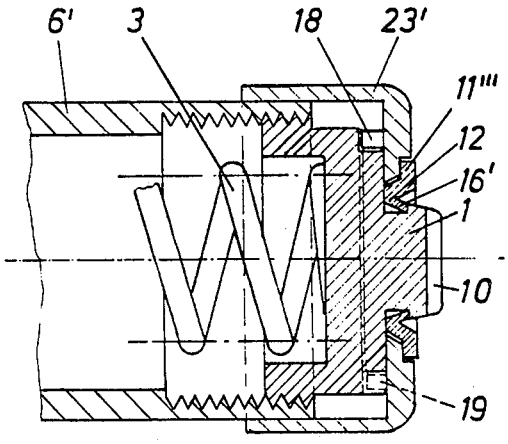
Figure 8:
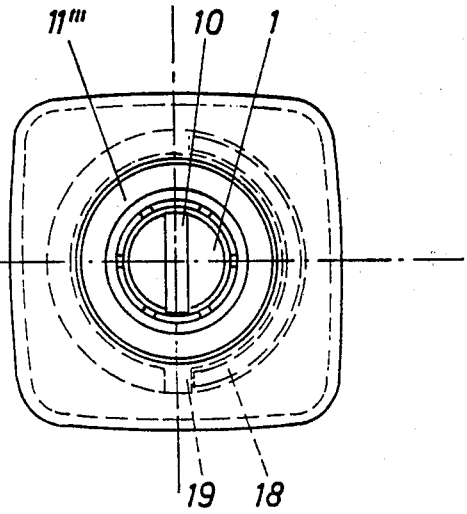

In the exemplary embodiment according to FIGS. 7 and 8, the closing element 11''' is arranged such that an adjustment of the final control element 1 is possible within certain limits. For this purpose, the course of rotation of the final control element 1 is limited by a stop 18, which cooperates with a projection 19 on the final control element 1. The largest possible rotation is thereby determined by the dimensions of the stop 18 and the projection 19. In the present exemplary embodiment, the range of adjustment of the final control element 1 by the skier is limited to 180°. The extent of the rotation can be increased up to approximately 350°; in this case the range of 10° is taken up by the two cooperating structural parts, namely, the stop 18 and the projection 19. A forced rotation of the final control element 1 beyond the limits would lead to a readily visible destruction of the hooks or barbs 16' closing element 11''' at the preset breaking points 12. Further details of this construction correspond substantially with the already described constructions; the housing 6' and the cover 23' between which the final control element 1 is arranged for adjusting the spring 3, are here mentioned only very briefly.

The invention is not limited to the described exemplary embodiments. Further modifications are possible without departing from the scope of the invention. Since the skier cannot perform an unauthorized adjustment by means of a common control element, for example by means of a coin, he could by using a pair of pliers or the like operate also without damage to the closing element the final control element, if same projects from the binding. To provide a remedy in this type of construction, a cover, approximately in the form of half of a cup, can be provided on the housing for the projecting part of the final control element, so that the final control element also cannot be turned with the aid of a pair of pliers or the like. However, it is also possible to envelope the entire projecting area of the final control element. The closing element can also be manufactured of a material which rigidifies later and which is poured into the slot and solidifies therein, or can be produced of a mixture of two materials which solidify after being mixed. Important is that the closing element cannot be removed from the slot without visible damage thereto and cannot be reinserted into the slot.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. The combination of a release ski binding having a housing and an adjustable spring abutment thereon for changing the effective force of a spring in said ski binding housing, said adjustable spring abutment being initially exposed through an opening in said ski binding housing, and a seal member of brittle material for indicating that an adjustment of said adjustable spring abutment has taken place subsequent to an authorized adjustment thereof, said seal member being received in said opening in said ski binding housing directly in the pathway to said adjustable spring abutment, said seal member having destructible means thereon for securely holding said seal means in said pathway to prevent ready access to said adjustable spring abutment, said adjustable spring abutment means being adjustable only through a destruction of said destructible means, said adjustable spring abutment being threadedly coupled to said ski binding housing and having means thereon for receiving an adjustment tool therein, said destructible means on said seal member being positioned between said adjustable spring abutment and said ski binding housing whereby an axial movement of said adjustable spring abutment in response to a rotary movement thereof in said threaded coupling beyond a predetermined limit will cause a destruction of said destructible means.

2. The combination according to claim 1, including stop means for limiting the amount of relative movement between said adjustable spring abutment and said ski binding housing.

3. The combination according to claim 1, wherein said destructible means faces outwardly of said ski binding housing and is readily visible.

4. The combination of a release ski binding having a housing and an adjustable spring abutment thereon for changing the effective force of a spring in said ski binding housing, said adjustable spring abutment having a tool receiving opening, said tool receiving opening in said adjustable spring abutment being initially exposed through an opening in said ski binding housing, and a seal member of brittle material for indicating that an adjustment of said adjustable spring abutment has taken place subsequent to an authorized adjustment thereof, said seal member being received in said opening in said ski binding housing directly in the pathway to said adjustable spring abutment, said seal member having an integral segment received in the entirety of said tool receiving opening to thereby prevent a relative rotational movement therebetween, said seal member further having destructible means thereon for securely holding said seal means in said pathway to prevent ready access to said tool receiving opening on said adjustable spring abutment, said adjustable spring abutment means being accessible and thereby adjustable only through a destruction of said destructible means and a removal of said integral segment from said tool receiving opening, said seal member having two elongated and parallel extensions thereon, each of said two extensions having a hook adjacent the free end thereof, said hooks operatively engaging said ski binding housing, said destructible means being provided adjacent each of said hooks and including a preset breaking point, said hooks preventing a removal of said seal member without destruction occurring at said preset breaking point.

* * * * *